US006374756B1

(12) United States Patent
Fieldwick et al.

(10) Patent No.: US 6,374,756 B1
(45) Date of Patent: Apr. 23, 2002

(54) FOLDING TABLE

(75) Inventors: John Edward Fieldwick, Near Folestone; Andrew Francis McCaffrey, Reading, both of (GB)

(73) Assignee: Gopak Limited (GB)

( * ) Notice: Subject to any disclaimer, the term of this patent is extended or adjusted under 35 U.S.C. 154(b) by 0 days.

(21) Appl. No.: 09/623,368

(22) PCT Filed: Feb. 12, 1999

(86) PCT No.: PCT/GB99/00452

§ 371 Date: Nov. 20, 2000

§ 102(e) Date: Nov. 20, 2000

(87) PCT Pub. No.: WO99/44469

PCT Pub. Date: Sep. 10, 1999

(30) Foreign Application Priority Data

Mar. 2, 1998 (GB) ..... 9804288

(51) Int. Cl.[7] ..... A47B 3/08
(52) U.S. Cl. ..... 108/131; 108/133
(58) Field of Search ..... 108/126, 130, 108/129, 125, 131, 132, 133; 248/188.6

(56) References Cited

U.S. PATENT DOCUMENTS 1,063,642 A * 6/1913 Birdsall ..... 108/131
2,147,972 A * 2/1939 Edwards ..... 108/133
2,178,248 A * 10/1939 Bristow
2,695,827 A * 11/1954 De Saussure, Jr. ..... 108/129
2,913,295 A * 11/1959 Park
3,143,982 A * 8/1964 Blink et al. ..... 108/130 X
4,658,735 A * 4/1987 Holton ..... 108/131
5,109,778 A * 5/1992 Berkowitz et al. ..... 108/127

FOREIGN PATENT DOCUMENTS

AU 250194 * 5/1963 ..... 108/132
FR 637771 * 5/1928
GB 613359 * 11/1948

* cited by examiner

*Primary Examiner*—Janet M. Wilkens
(74) *Attorney, Agent, or Firm*—Levy & Grandinetti

(57) ABSTRACT

A folding table (2) of robust construction having a reinforced picture-frame edge and underside elongate chassis members (24, 26) running along the length thereof, the chassis member (26) pivotally supporting two pairs of legs (6) and opposed track elements (40, 46) associated with each pair of legs. The track elements (40, 46) accommodate followers (50) attached to opposite ends (52, 53) of a connecting element (52) to which are fixedly secured legs (56, 58) of a support frame (54), legs (56, 58) of which pivotally connect the connecting element (52) to the legs (6) so that movement of the followers (50) in the track elements causes movement of the pairs of legs (6) between a first inoperative position and a second operative position. Latching members (70) are provided to lock each pair of legs (6) in one or other of their inoperative and operative positions and damper members (90, 140) are provided on each leg (32, 36) to prevent rapid movement of legs (32, 36) between said positions.

8 Claims, 8 Drawing Sheets

FOLDING TABLE

This invention is concerned with improvements in or relating to a folding table.

Such tables are well known for use as card tables, picnic tables and a more robust construction that may be utilised for refectory or canteen tables, which may be folded and stacked away after use.

However, even the more robust tables available hitherto, leave a lot to be desired when it comes to their inherent strengths and of late, it has become evident that folding tables must be designed to a very high specification if they are to be fit for their purpose.

Generally, the prior art, of which the disclosures of GB 613,359, FR 637,771 and U.S. Pat. No. 2,178,248 are prime examples, relates to a folding table comprising a pair of legs mounted at or towards each end of the table and enabling means associated with each pair of legs for enabling movement of the legs between a first position in which the legs lie adjacent an underside of the table, or substantially so, and a second position in which the legs extend at a right angle, or substantially so, to the underside of the table to support the table in conventional manner, wherein, each enabling means comprises two tracks fixedly mounted one on each side of the table, one track being a mirror image of the other, tracking elements each mounted for movement along an associated one of the tracks, and means connecting each of said tracking elements with an associated pair of legs to facilitate movement of the legs between their respective first and second positions as aforesaid.

While the tables of GB 613,359, FR 637,771 and U.S. Pat. No. 2,178,248 may find application as occasional tables, they are either lacking in strength for the purpose or they include complex unlatching mechanisms for releasing the legs from their second positions when folding the tables for storage. In addition, while the tables of these prior art documents include latching means for securing the legs of the tables in their second positions, they do not include a similar feature for securing the legs of the tables in their first positions.

The unlatching mechanism of U.S. Pat. No. 2,178,248 is arranged to act in tandem to release both legs of a pair of legs simultaneously, however, to effect such release it is required that the table be fully inverted and for foot pressure to be exerted on a bar connecting the release mechanism associated with each leg of the pair of legs. This is a cumbersome and somewhat impracticable means for releasing the pairs of legs and may not be readily achievable by everyone who needs to fold such a table for storage purposes.

The present invention seeks to mitigate or obviate the disadvantages of prior arrangements and thus provides an improved folding table comprising a pair of legs pivotally mounted at or towards each end of the table and enabling means associated with each pair of legs for enabling movement of the legs between a first position in which the legs lie adjacent an underside of the table, or substantially so, and a second position in which the legs extend at a right angle, or substantially so, to the underside of the table to support the table in conventional manner, wherein each enabling means comprises two tracks fixedly mounted one on each side of the table, one track being a mirror image of the other, tracking elements each mounted for movement along an associated one of said tracks, and means connecting each of said tracking elements with an associated pair of legs to facilitate movement of the legs between said first and second positions, characterised in that each connecting means is pivotally mounted between an associated pair of legs and comprises a connecting element which extends beneath the table and wholly, or substantially so, between its associated tracks and provides one of said tracking elements at each end thereof for location in an associated one of the tracks.

Conveniently, the connecting means further comprises supports extending between opposite ends of the connecting element and an associated one of the legs of each pair of legs.

Preferably, the supports are each pivotally connected to its associated one of said legs whereby each connecting means is pivotally mounted between an associated pair of legs as aforesaid and the supports associated with each pair of legs are connected one to the other to add strength to the table leg structure.

In a table according to any one of the last three preceding paragraphs, latching mechanisms are provided for securing associated ones of the pairs of legs in their first or second positions, the latching mechanisms each being conveniently-mounted within its associated connecting element, each latching mechanism comprising a twin poppet arrangement biased by spring means to cause its associated poppets to be engaged in associated apertures provided in the tracks whereby, when the table is in use, the legs thereof are locked in one or other of their first and second positions.

Preferably, the latching mechanisms each comprise a pair of compression tabs slidably mounted within their respective connecting elements whereby, when the table is in use and the table legs are to be moved between their first and their second positions, movement of the pressure tabs of each pair towards each other causes movement of said poppets from their respective apertures to facilitate movement of the table legs as aforesaid.

Conveniently, damper means are provided to control the movement of the legs as they are moved between their first and second positions.

There now follows, by way of example of the present invention, a specific description of a novel folding table which description is to be read with reference to the accompanying drawings in which.

Figure 1:
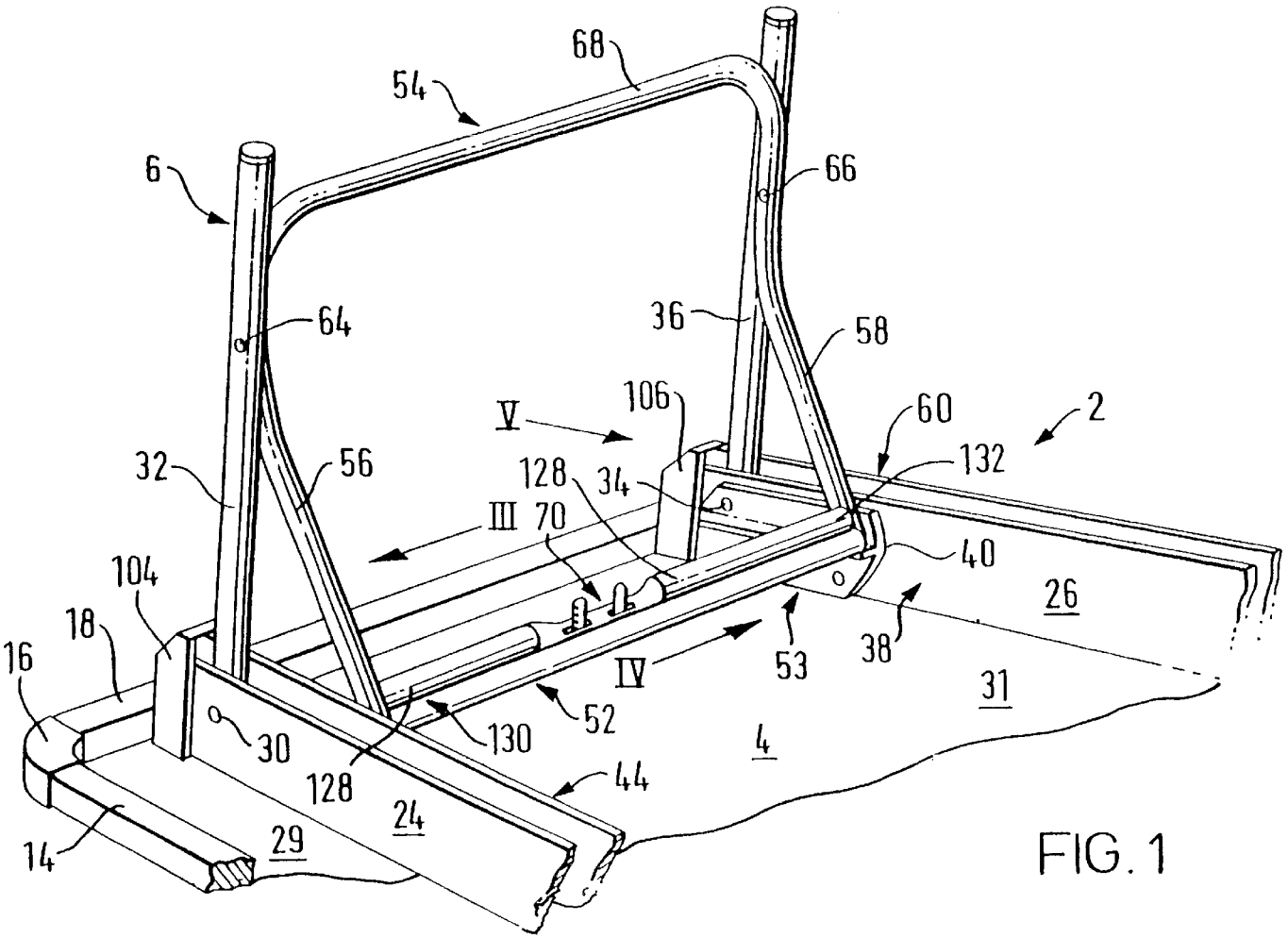
FIG. 1 is a fragmentary inverted end view of a folding table.
Figure 2:
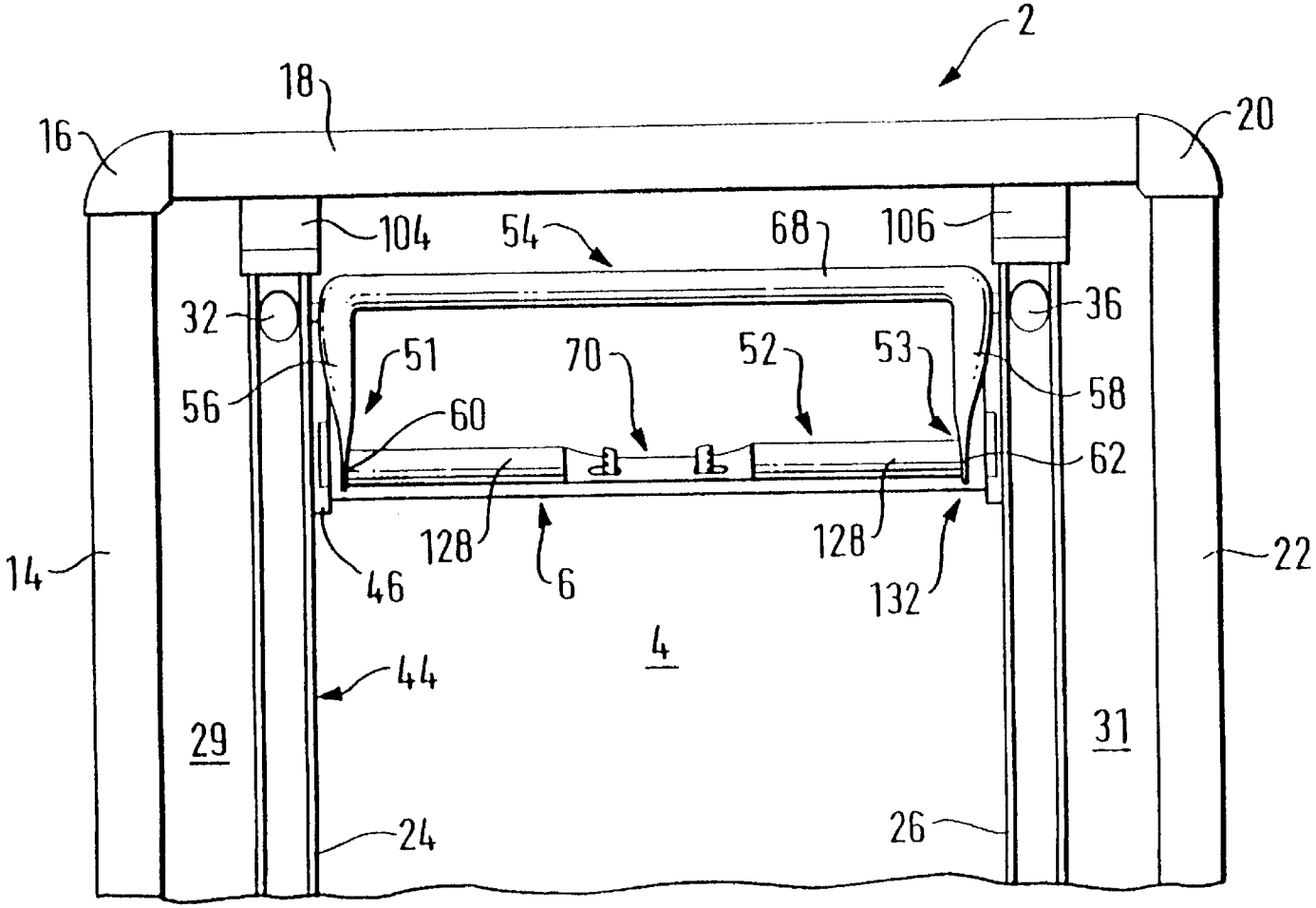
FIG. 2 is a fragmentary inverted plan view of the table.

The folding table 2 provided by the present invention, like prior art arrangements, generally comprises a table top 4 supported by two pairs of legs provided at opposite ends thereof, only one pair of legs is being shown in FIGS. 1 and 2 of the drawings.

The invention is concerned with the improved and strengthened arrangement provided for moving each pair of legs between an inoperative first position, in which the pairs of legs lie adjacent an underside 5 of the table or substantially so, and an operative second position, in which the pairs of legs extend at a right angle, or substantially so, to the underside of the table to support the table in conventional manner.

As the arrangement provided for moving each pair of legs is substantially the same, only the arrangement at one end of the table: will now be described in detail.

The folding table 2 is intended for use in a more robust environment than the picnic tables, card tables and utility tables presently available. Thus, the table 2 comprises a substantial table top 4 strengthened by a picture-frame configuration of aluminium extrusions 14, 18 and 22 and corner elements 16 and 20, see FIGS. 1 and 2.

On its underside 5, the table 2 comprises two chassis members 24 and 26 fixedly secured thereto and extending one on each side 29 and 31 respectively, along the table 2, see FIG. 1.

Figure 5:
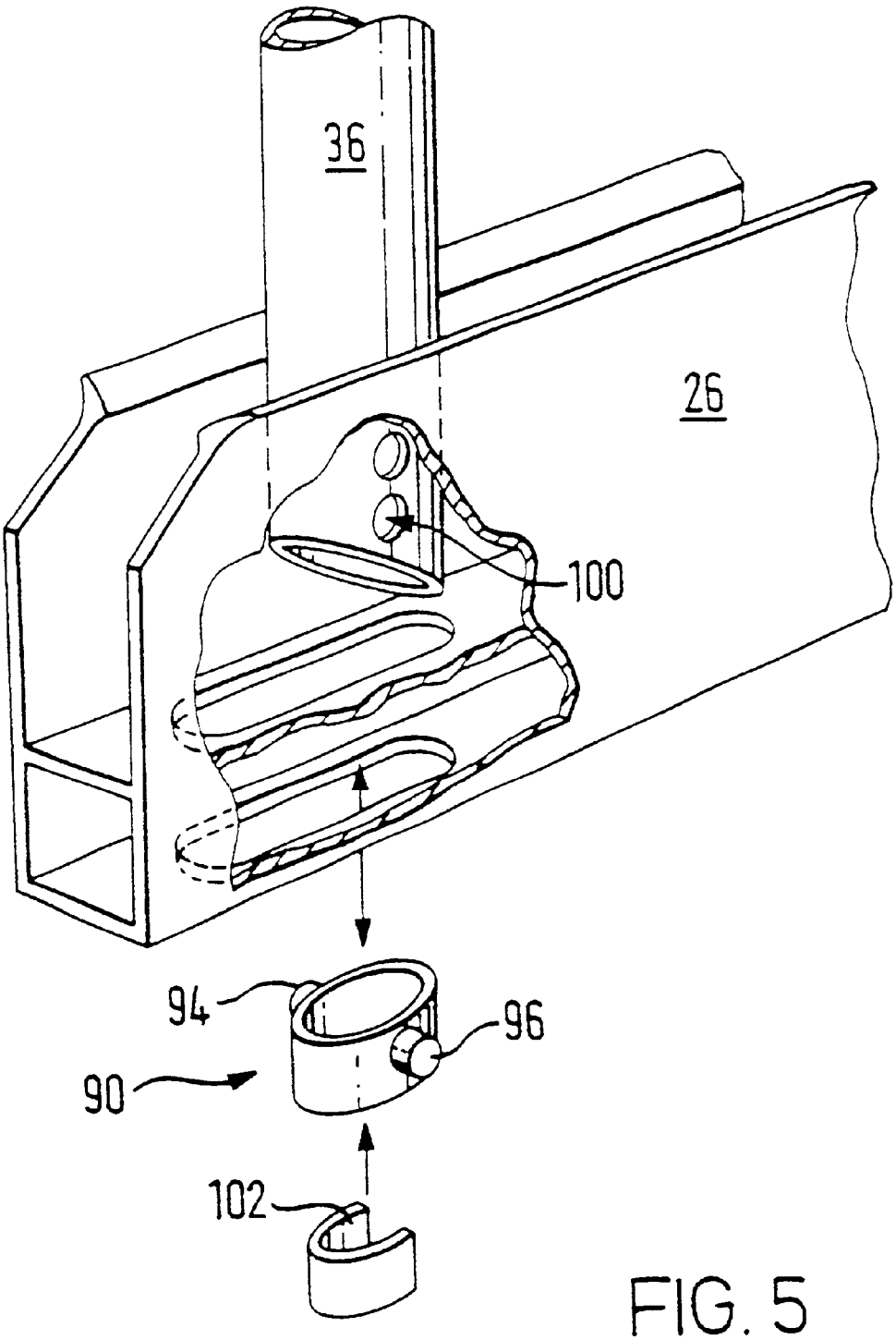
FIG. 5 is a fragmentary exploded view taken generally in the direction of the arrow V in FIG. 1.
Figure 6:
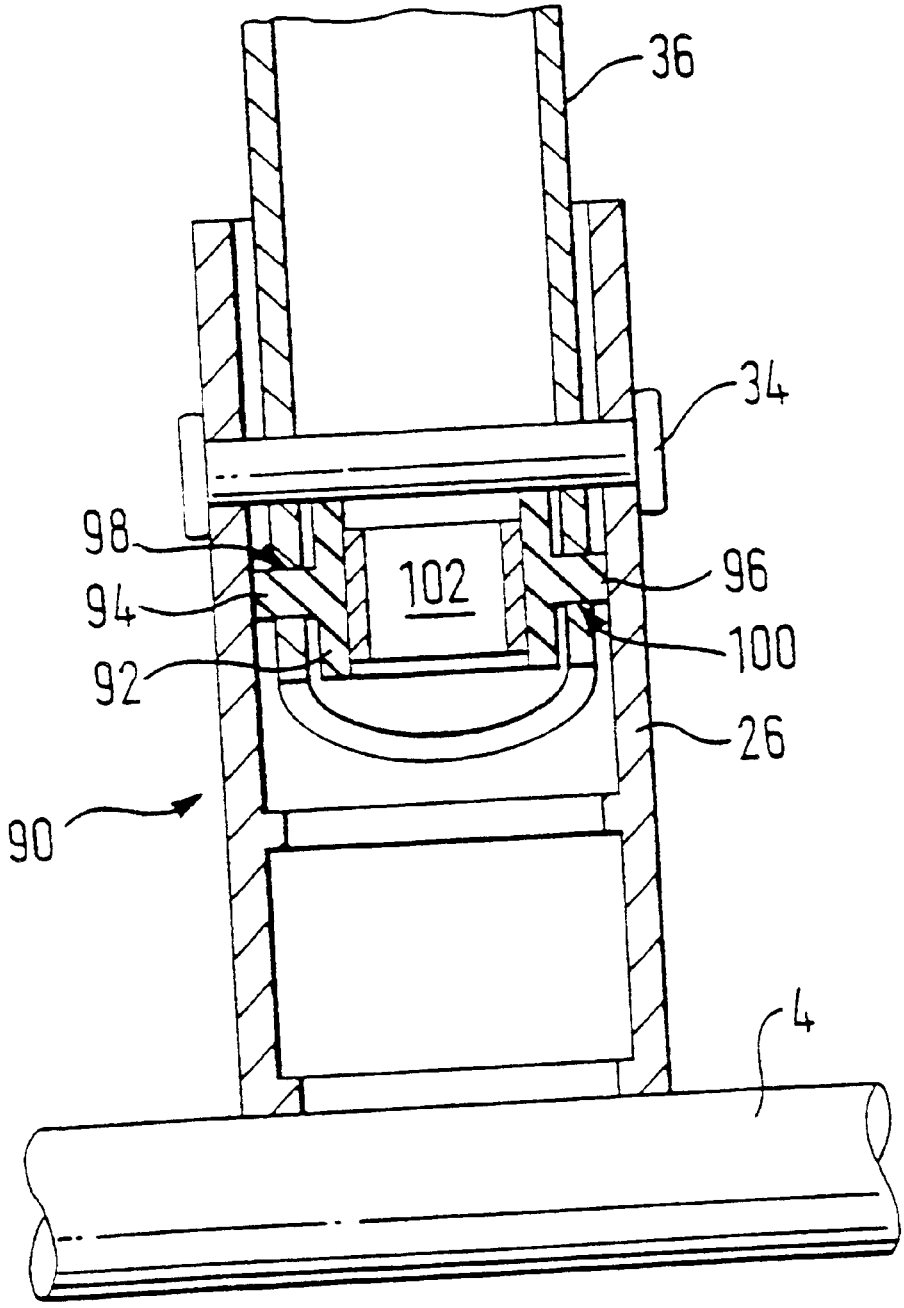
FIG. 6 is a section view of the parts shown in FIG. 5 when assembled together.

Each chassis member 24, 26 is provided by an aluminium extrusion of generally "U" shaped configuration, see FIGS. 5 and 6.

Figure 3:
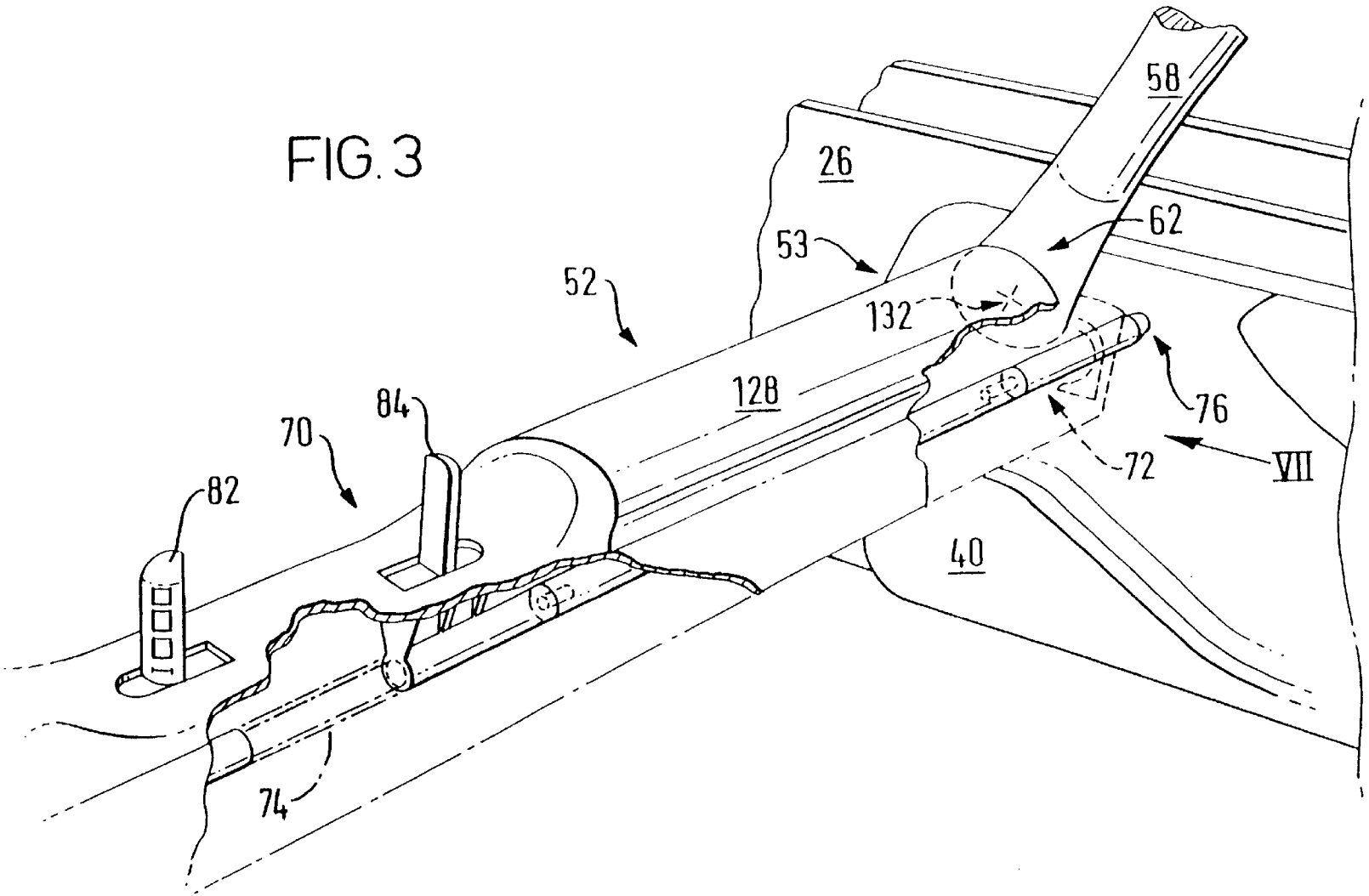
FIG. 3 is a fragmentary view taken generally in the direction of the arrow III in FIG. 1.

The chassis member 24 provides pivotal support at 30 for a first leg 32 and the chassis member 26 provides pivotal support at 34, for a second leg 36 of the pair of legs 6, see FIGS. 1, 2 and 3.

The chassis member 26 provides support on an inside face 38 for a track element 40 comprising a cam surface 42 adapted to receive in engagement therewith a first tracking element to be described hereinafter.

The chassis member 24 likewise provides support on an inside face 44, for a track element 46 which is a mirror image of the element 40 and likewise comprises a cam surface (not shown) adapted to receive in engagement therewith a second tracking element (not shown) to be described hereinafter.

Figure 7:
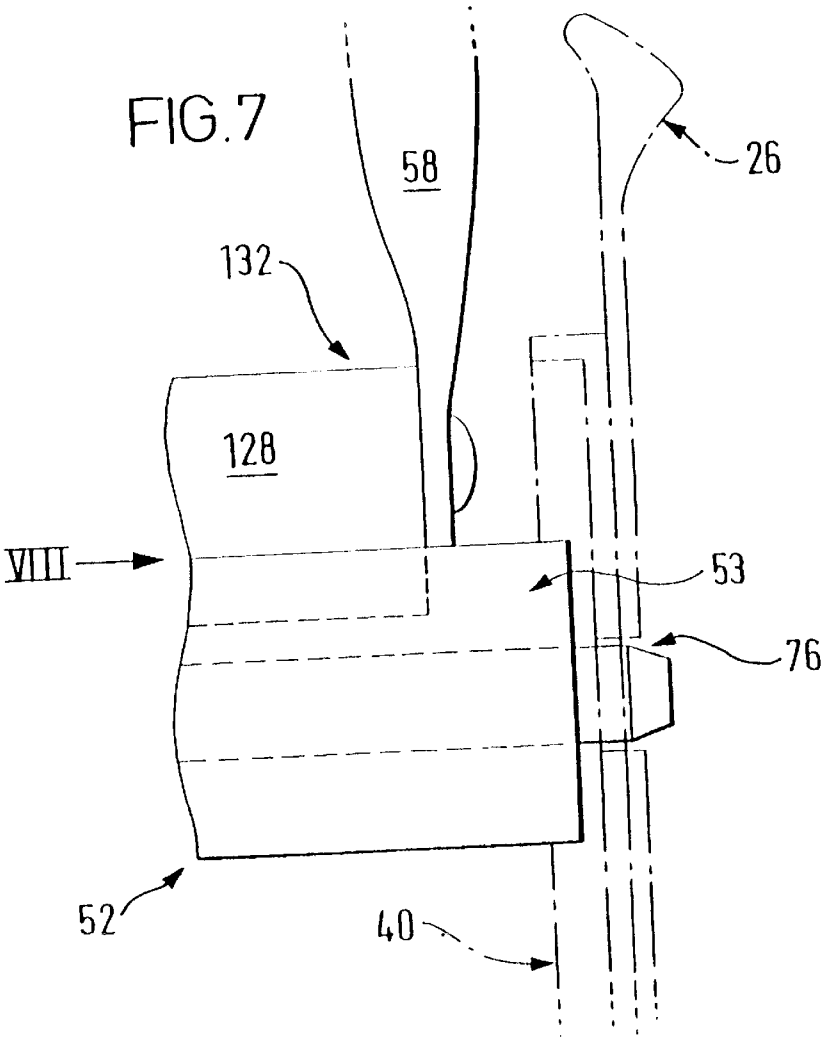
FIG. 7 is a fragmentary view in the direction of the arrow VII in FIG. 3.
Figure 8:
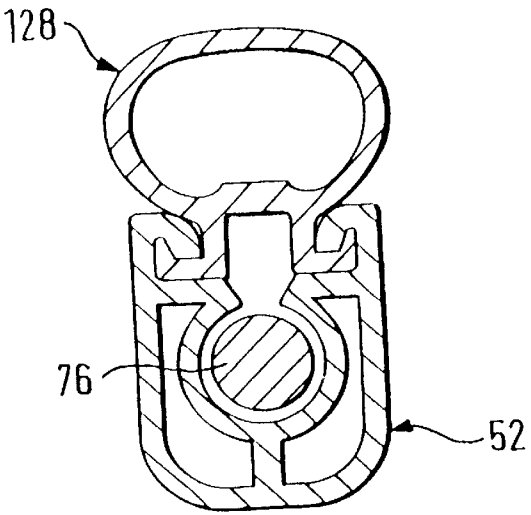
FIG. 8 is a section view taken in the direction of arrow VIII in FIG. 7.

The first and second tracking elements, only one of which is shown diagrammatically in FIG. 7, are provided by opposite end positions 51 and 53 of a connecting element 52.

The connecting element 52 is formed as an elongate extrusion and provides support for an elongate connecting element 128, see FIGS. 1, 3, 7 and 8.

The element 128 is connected at opposite ends 130 and 132 to respective end portions 60 and 62 of legs 56 and 58 of an inverted "C" frame support member 54, see FIG. 1.

The two legs 56 and 58 of the member 54 are pivotally connected at 64 and 66 to the legs 32 and 36, an arm 68 of the support member 54 connecting the two legs 56 and 58 to further strengthen the assemblage and add rigidity to the pairs of legs and thus the table 2.

The folding table 2 comprises latching means 70 for locking the pair of table legs 6 in either their inoperative first position or their operative second position.

The latching means 70, which is mounted within the connecting element 52, see FIG. 3, comprises a twin poppet arrangement 72 biased by a spring 74 to cause an appositely disposed pair of poppets 76, only one of which is shown in FIG. 3, to be engaged or disengaged in apertures 78 and 80 provided in the track elements 40 and 46, see FIG. 7 in which it is evident that the aperture 80 extends through the elements 40 and 46 and through the respective chassis members 24 and 26.

When the pair of legs 6 are in their inoperative first position, the poppets 76 are locked in the apertures 78 and the legs 32 and 36 lie adjacent or substantially adjacent to the underside of the table 2, within the confines of their respective chassis' 24 and 26. Conversely, when the pair of legs are in their operative second position the poppets 76 are located in the apertures 80 and the legs 32 and 36 extend at a right angle, or substantially so, to the underside of the table as aforesaid to support the table in conventional manner.

It will be evident that in either position one merely has to operate compression tabs 82 and 84 of the latching means 70 to compress the spring 74 to disengage the poppets 76 and pivot the legs 32 and 36 between their inoperative and operative positions.

In order to avoid over rapid movement of the legs 32 and 36 between their inoperative and operative positions, each leg is provided with a damper means 90, however, only that associated with the leg 6 is shown in FIGS. 5 and 6.

The damper means 90 comprises a rubber moulding 92 which is cylindrical in cross-section and has two spigots 94 and 96 moulded thereon. The moulding located as shown in FIGS. 5 and 6 inside the end of the leg 36 with the spigots 94 and 96 extending through associated apertures 98 and 100 respectively in the leg 36. A spring clip 102 is inserted within the moulding 92 to retain it on situ and to force the spigots outwardly, viewing FIG. 6, into engagement with inside walls of the chassis member 26. Thus, the speed of movement of the leg 36 is damped as it is moved between its inoperative first position and its operative second position.

Figure 4:
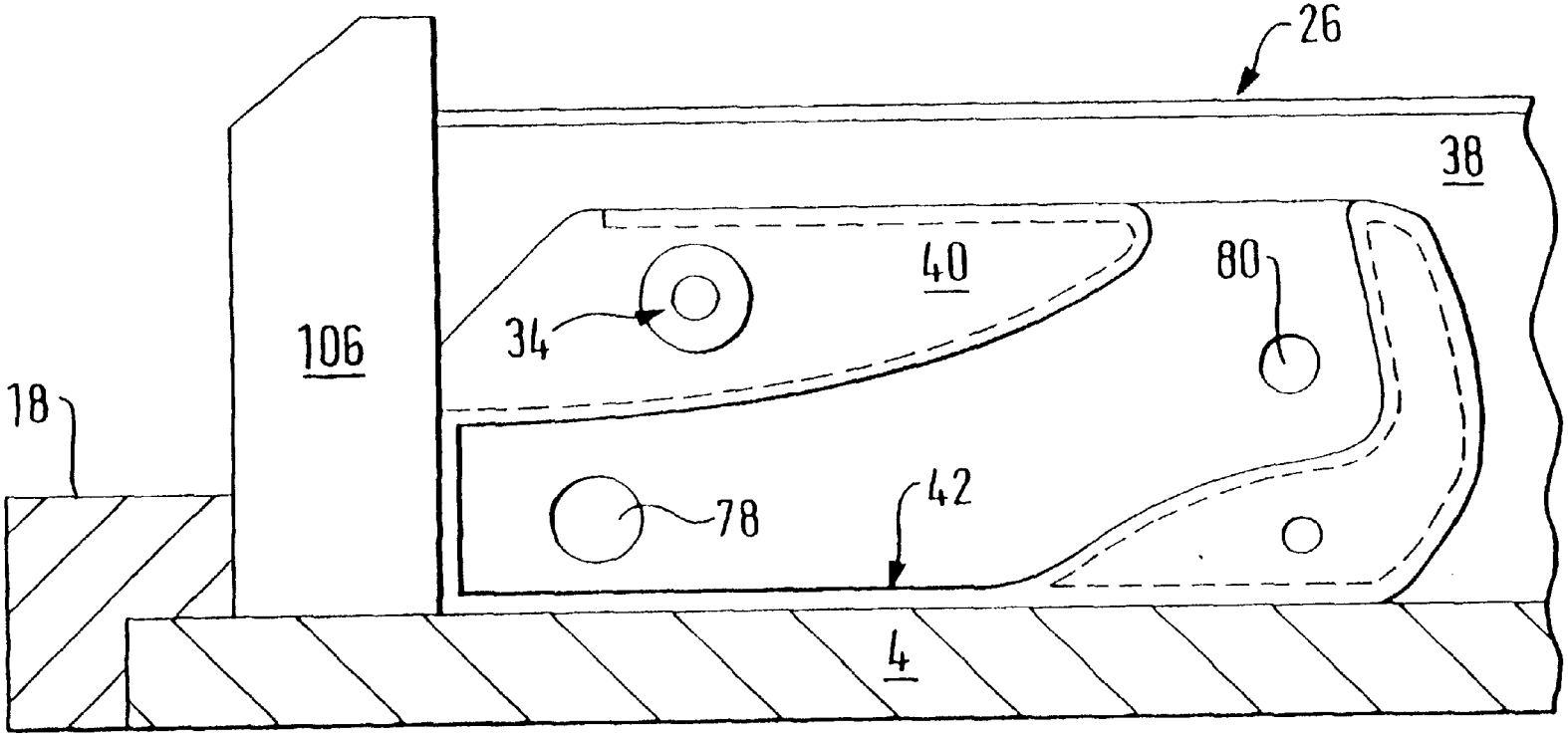
FIG. 4 is a fragmentary view taken generally in the direction of the arrow IV in FIG. 1.

At each end thereof, the chassis members 24 and 26 are closed by end supports 104 and 106 respectively, which end supports extend in height, see FIG. 4, above the depth of the chassis members 24 and 26.

This extra depth to the end supports 104 and 106 provides stacking faces to allow the legs 32 and 36 to be fully accommodated with the "U" shaped chassis 24 and 26 and enable folded tables 2 to be neatly stacked one upon the other with the stacking faces acting as feet on which the tables are located.

Figure 10:
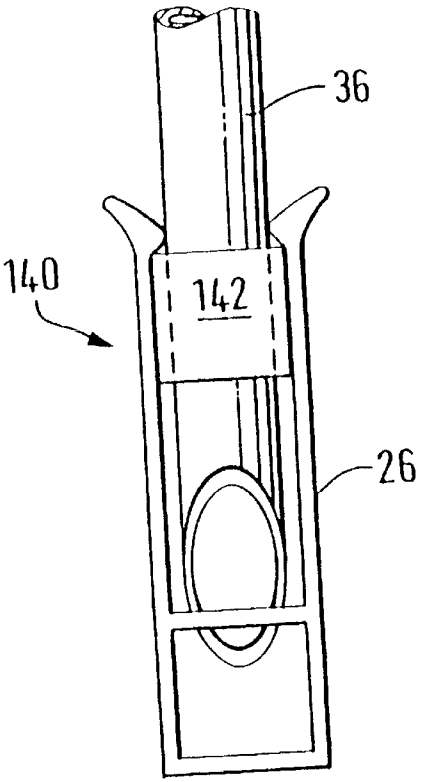
FIG. 10 is a view in the direction of arrow X in FIG. 9.
Figure 9:
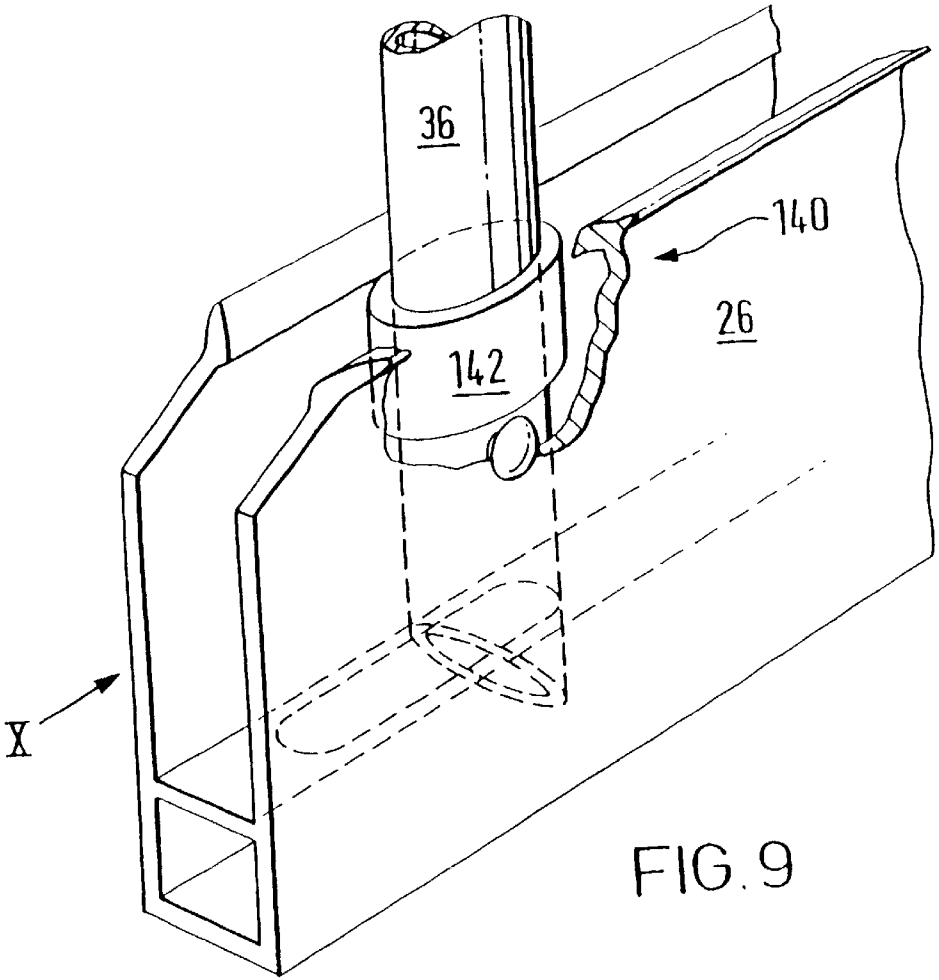
FIG. 9 is a fragmentary view corresponding to FIG. 6 but showing a modified damper means.

In a modified arrangement, the folding table 2 is provided with a damper means 140 which comprises an extruded rubber sleeve 142 located on the leg 36 as shown in FIGS. 9 and 10.

The remaining legs of the table may be provided with damper means 140 instead of the damper means 90.

In uses the rubber sleeve 142 acts between the leg 36 and the inside walls of the chassis members 24 and 26 to avoid over-rapid movement of the legs 32 and 36 when moving between their inoperative and operative positions and vice versa.

While the damper means include mouldings of rubber it is to be appreciated that mouldings of any other suitable materials may be utilised, for example the mouldings may alternatively be of a plastics material.

It will be appreciated from the foregoing that the table of the present invention provides a robust structure both in its folded and erected conditions with the incidence of damage in use being greatly reduced.

PARTS LIST

2 folding table
4 table top
5 underside
6 legs
8
10
12 table top
14 aluminium extension
16 aluminium extension
18 aluminium extension
20 aluminium extension

22 aluminium extension
24 chassis member
26 chassis member
28
29 table side
30 pivot
31 table side
32 first leg
34 pivot
36 second leg
38 inside face
40 track element
42 cam surface
44 inside face
46 track element
48
50 cam
51 end
52 connecting element
53 end
54 "C" frame member
56 leg
58 leg
60 end of leg 56
62 end of leg 58
64 pivot
66 pivot
68 arm of "C" member
70 latching means
72 poppets
74 spring
76 poppets
78 apertures
80 apertures
82 tab
84 tab
86
88
90 damper
92 rubber moulding
94 spigot
96 spigot
98 aperture
100 aperture
102
104 support
106 support
128 connecting element
130 end
132 end

What is claimed is:

1. A folding table (2) comprising a pair of legs (6) pivotally mounted at or towards each end of the table and enabling means associated with each pair of legs (32, 36) for enabling movement of the legs (32, 36) between a first position in which the legs (32, 36) lie adjacent an underside (5) of the (2), or substantially so, a and a second position in which the legs (32, 36) extend at a right angle, or substantially so, to the underside (5) of the table (2) to support the table (2) in conventional manner, wherein each enabling means comprises two tracks (40, 46) fixedly mounted one on each side (29, 31) of the table (2), one track (40, 46) being a mirror image of the other, tracking elements (51, 53) each mounted for movement along an associated one of said tracks (40, 46), and mean s connecting each of said tracking elements (51, 53) with an associated pair of legs (32, 36) to facilitate movement of the legs (32, 36) between said first and second positions, characterised in that each connecting means is pivotally mounted between an associated pair of legs (32, 36) and comprises a connecting element (52, 128) which extends beneath the table and wholly, or substantially so, between its associated tracks (40, 46) and pro vide s one of said tracking elements (51, 53) at each end thereof for location in an associated one of the tracks (42, 46).

2. A table (2) according to claim 1 characterised in that the connecting means further comprises supports (56, 58) extending between opposite ends of the connecting element (52, 128) and an associated on e of the legs (32, 36) of each p air of legs (6).

3. A table according to claim 2 characterised in that the supports (56, 58) are each pivotally connected to its associated one of said legs (32,36) whereby each connecting means is pivotally mounted between an associated pair of legs (6) as aforesaid.

4. A table (2) according to claim 2 characterised in that the supports (56, 58) associated with each pair of legs (6) are connected one to the other to add strength to the table leg structure.

5. A table (2) according to claim 4 characterised in that latching mechanisms (70) are provided for securing associated ones of the pairs of legs (6) in their first or second positions.

6. A table (2) according to claim 5 characterised in that the latching mechanisms (70) are each mounted within its associated connecting element (52, 128), each latching mechanism (70) comprising a twin poppet arrangement (72, 76) biased by spring means (74) to cause its associated poppets (72, 76) to be engaged in associated apertures (78, 80) provided in the tracks (40, 46) whereby, when the table (2) is in use, the legs (6) thereof are locked in one or other of their first and second positions.

7. A table (2) according to claim 6 characterised in that the latching mechanisms (70) each comprise a pair of compression tabs (82, 84) slidably mounted within their respective connecting elements (52, 128) whereby, when the table (2) is in use and the table legs (32, 36) are to be moved between their first and their second positions, movement of the tabs (82, 84) of each pair towards each other causes movement of said poppets (72, 76) from their respective apertures (78, 80) to facilitate movement of the table legs (32, 36) as aforesaid.

8. A table (2) according to claim 7 characterised in that damper means (90) are provided to control the movement of the legs (32, 36) as they are moved between their first and second positions.

* * * * *